US009274458B2

(12) United States Patent
Rokugawa

(10) Patent No.: US 9,274,458 B2
(45) Date of Patent: Mar. 1, 2016

(54) IMAGE FORMATION DEVICE

(71) Applicant: Oki Data Corporation, Tokyo (JP)

(72) Inventor: Hiroshi Rokugawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/745,518

(22) Filed: Jun. 22, 2015

(65) Prior Publication Data

US 2015/0370200 A1 Dec. 24, 2015

(30) Foreign Application Priority Data

Jun. 24, 2014 (JP) ..... 2014-129584

(51) Int. Cl.
*G03G 15/01* (2006.01)
*G03G 15/16* (2006.01)

(52) U.S. Cl.
CPC ..... *G03G 15/1605* (2013.01)

(58) Field of Classification Search
CPC ..... G03G 15/1605
See application file for complete search history.

(56) References Cited

U.S. PATENT DOCUMENTS

2010/0329707 A1* 12/2010 Yamada ..... G03G 15/161 399/44
2014/0079458 A1* 3/2014 Seto ..... G01N 19/10 399/389

FOREIGN PATENT DOCUMENTS

JP 2008-076469 A 4/2008

* cited by examiner

*Primary Examiner* — David Gray
*Assistant Examiner* — Michael Harrison
(74) *Attorney, Agent, or Firm* — Mots Law, PLLC

(57) ABSTRACT

An image formation device comprises: a first image carrier for a first developer image; a second image carrier for a second developer image; an intermediate transfer body opposed to the first image carrier and the second image carrier; a first transfer unit to transfer the first developer image to the intermediate transfer body; a second transfer unit to transfer the second developer image onto the first developer image transferred onto the intermediate transfer body; a third transfer unit to transfer, to a recording medium, the first and second developer images transferred onto the intermediate transfer body; and a control unit to control a value of a voltage to be applied to each of the first and second transfer units, according to a type of the recording medium.

10 Claims, 9 Drawing Sheets

FIG. 3

| | PRIMARY TRANSFER VOLTAGE VALUE | | | | SECONDARY TRANSFER VOLTAGE VALUE |
|---|---|---|---|---|---|
| | YELLOW | MAGENTA | CYAN | BLACK | |
| REGULAR PAPER MODE | 1600V | 1600V | 1600V | 1600V | 1800V |
| OHP MODE | 1600V | 1600V | 1600V | 3200V | 3000V |

| PRIMARY TRANSFER VOLTAGE VALUE (V) | DISCHARGE PATTERN |
|---|---|
| 1200 | × |
| 1600 | × |
| 2000 | × |
| 2400 | × |
| 2800 | × |
| 3200 | ○ |
| 3600 | ○ |
| 4000 | ○ |
| 4400 | ○ |

FIG. 9

| TABLE NAME | TYPE OF RECORDING MEDIUM | TEMPERATURE, HUMIDITY | PRIMARY TRANSFER VOLTAGE VALUE | | | | SECONDARY TRANSFER VOLTAGE VALUE |
|---|---|---|---|---|---|---|---|
| | | | YELLOW | MAGENTA | CYAN | BLACK | |
| T1 | REGULAR PAPER MODE | LOWER THAN 10°C OR LOWER THAN 20% | 1600V | 1600V | 1600V | 1600V | 1800V |
| T2 | | 10°C OR HIGHER AND 20% OR HIGHER | 1500V | 1500V | 1500V | 1500V | 1400V |
| T3 | OHP MODE | LOWER THAN 10°C OR LOWER THAN 20% | 1600V | 1600V | 1600V | 3200V | 3000V |
| T4 | | 10°C OR HIGHER AND 20% OR HIGHER | 1500V | 1500V | 1500V | 1500V | 2500V |

IMAGE FORMATION DEVICE

CROSS REFERENCE TO RELATED APPLICATIONS

This application claims priority based on 35 USC 119 from prior Japanese Patent Application No. JP2014-129584 filed on Jun. 24, 2014, entitled "IMAGE FORMATION DEVICE", the entire contents of which are incorporated herein by reference.

BACKGROUND OF THE INVENTION

1. Field of the Invention

This disclosure relates to an image formation device and is applicable to an image formation device that forms an image on a recording medium by using an electrophotographic system, for instance.

2. Description of Related Art

An image formation device which adopts an electrophotographic system includes an image formation unit having a photoconductive drum, a charge unit, an exposure unit, a development unit, and other components. In a color image formation device which adopts an intermediate transfer system, for instance, image formation units which use developers of colors are disposed in a certain order in the rotation direction of an intermediate transfer belt. The image formation units primarily transfer toner images successively onto the intermediate transfer belt, and the toner images primarily transferred on the intermediate transfer belt are secondarily transferred to a recording medium by a secondary transfer roller. After the toner image transfer, the recording medium is transported to a fixture device, and the fixture device fixes the toner image onto the recording medium to form an image on the recording medium.

In such an image formation device, a film sheet for an overhead projector (OHP), for instance, or the like (which is called an OHP film, for instance) is used as a recording medium in addition to regular paper.

[Patent Document 1] Japanese Patent Application Publication No. 2008-76469

SUMMARY OF THE INVENTION

However, in the above-described image formation device, discharge may occur between the recording medium and a charge removal member or the like on a transport path when the recording medium comes close to the charge removal member or the like after the secondary transfer and before the fixture. This causes the electric charge to locally increase in a discharge area on the recording medium and forms an electric field on the recording medium. As a result, the toner before being fixed is moved due to the electric field, thereby causing an image defect. Hereinafter, the image defect of this type is called a "discharge pattern".

In the case of using a recording medium, such as the above-mentioned OHP film, which has a high resistance value and tends to be excessively charged on its surface, a discharge pattern is likely to occur. Among the image formation units, the image formation unit disposed the most downstream in the rotation direction of the intermediate transfer belt is likely to cause a discharge pattern because a charge amount of toner of the toner image on the intermediate transfer belt cannot be increased when the toner image passes by the image formation unit.

In short, there is a problem in that when a recording medium having a high resistance value like an OHP film is used in an image formation device, a discharge pattern may occur in a print result of the image formation unit most downstream in the rotation direction of the intermediate transfer belt.

For this reason, there is a demand for an image formation device capable of inhibiting a discharge pattern from occurring by making the toner less likely to move even when a discharge occurs on the surface of a recording medium after the secondary transfer and before the fixture.

An aspect of the invention is an image formation device for forming developer images using plural types of developers. The image formation device comprises: a first image carrier configured to carry a first developer image; a second image carrier configured to carry a second developer image; an intermediate transfer body disposed to be opposed to the first image carrier and the second image carrier; a first transfer unit configured to transfer the first developer image from the first image carrier to the intermediate transfer body; a second transfer unit configured to transfer the second developer image from the second image carrier onto the first developer image transferred onto the intermediate transfer body; a third transfer unit configured to transfer, to a recording medium, the first developer image and the second developer image transferred onto the intermediate transfer body; and a control unit configured to control a value of a voltage to be applied to each of the first transfer unit and the second transfer unit, according to a type of the recording medium.

According to an aspect of the invention, in the case of using a medium which tends to cause a discharge, the charge amount of toner on the intermediate transfer belt can be increased by controlling the voltage value to be applied to the first and second transfer units. This also increases the charge amount of toner secondarily transferred onto the recording medium, and thus increases the adhesion of the toner onto the recording medium. Thus, even when a discharge does occur on the surface of the recording medium after the secondary transfer and before the fixture, the toner is less likely to move, and therefore can be inhibited from causing a discharge pattern.

BRIEF DESCRIPTION OF THE DRAWINGS

FIG. 3 is an explanatory diagram illustrating the configuration of a transfer voltage setting table according to the first embodiment;

FIG. 9 is an explanatory diagram illustrating the configuration of a transfer voltage setting table of the image formation device according to the second embodiment.

DETAILED DESCRIPTION OF EMBODIMENTS

Figure 1:
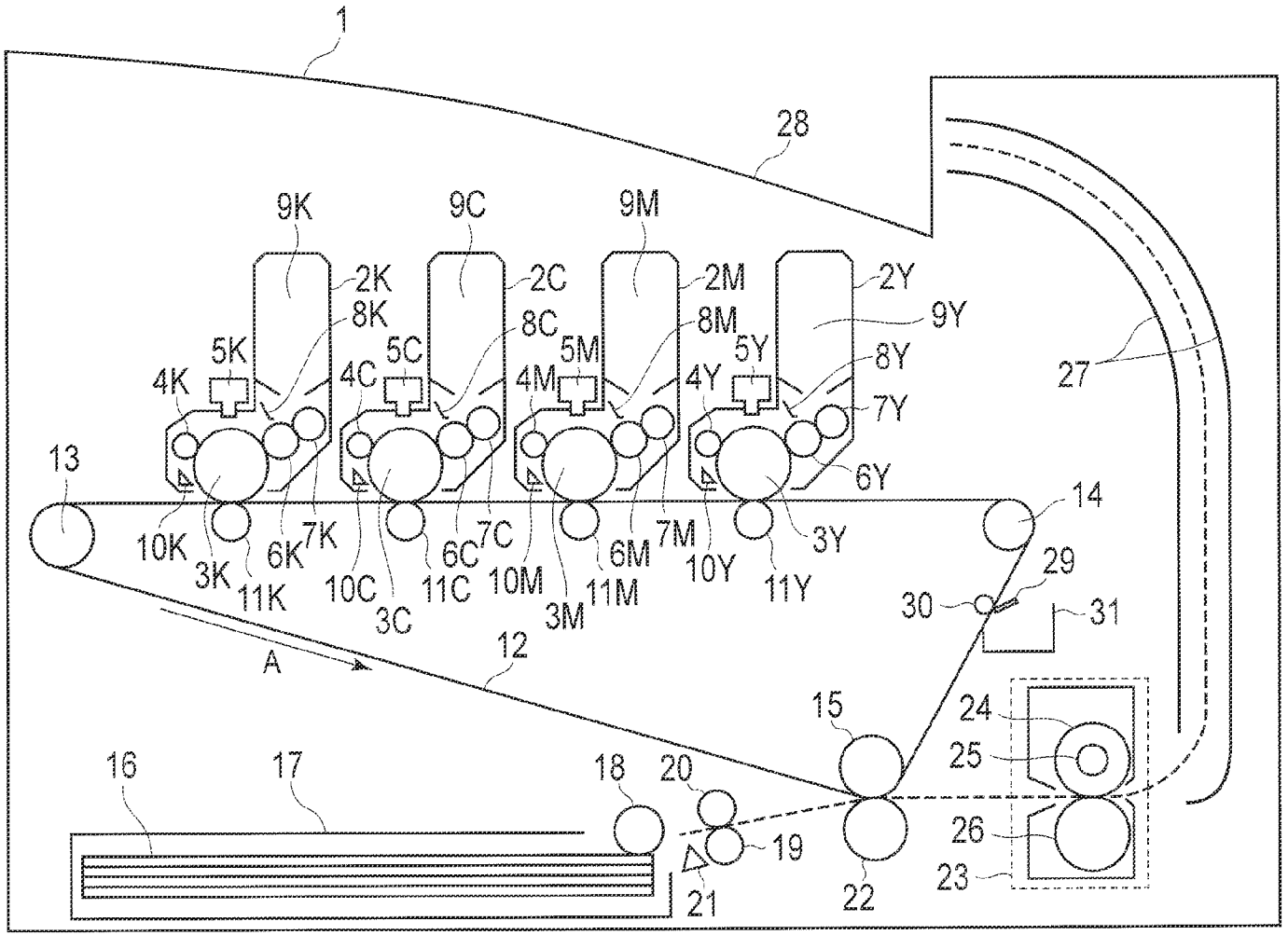
FIG. 1 is an internal configuration diagram illustrating the internal configuration of an image formation device according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

(A) First Embodiment

Hereinafter, a first embodiment of an image formation device according to the invention is described in detail with reference to the accompanying drawings.

In the first embodiment, a case is exemplified where the invention is applied to an electrophotographic image formation device that adopts an intermediate transfer system.

(A-1) Configuration of First Embodiment

FIG. 1 is an internal configuration diagram illustrating the internal configuration of image formation device 1 according to the first embodiment.

In FIG. 1, image formation device 1 according to the first embodiment includes image formation units 2Y, 2M, 2C, 2K that use respective developers (hereinafter referred to as toner) of four colors, recording medium storage cassette 17, hopping roller 18, registration roller 19, pinch roller 20, registration sensor 21, primary transfer rollers 11Y, 11M, 11C, 11K, intermediate transfer belt 12, drive roller 13, driven roller 14, secondary transfer backup roller 15, secondary transfer roller 22, fixture unit 23, transport guide 27, stacker 28, cleaner blade 29, cleaner blade opposed roller 30, and waste toner tank 31.

Image formation device 1 is a device that forms an image on recording medium 16 using toner of four colors yellow (Y), magenta (M), cyan (C), and black (K). Here, recording medium 16 may be, for instance, regular paper, thick paper, or a resin medium. The resin medium is, for instance, a film sheet such as an OHP film sheet, a transparent medium, or a plastic plate that is made of, for instance, a polyethylene terephthalate (PET) resin as a raw material. In the first embodiment, a case is exemplified where recording medium 16 is an OHP film sheet.

It is to be noted that "the first type recording medium" described in the appended claims includes regular paper. Also, "the second type recording medium" is a concept that includes thick paper and a resin medium. The thickness (a second thickness) of the second type recording medium is thicker than the thickness (a first thickness) of the first type recording medium.

Image formation device 1 has four independent image formation units 2Y, 2M, 2C, 2K that correspond to yellow (Y), magenta (M), cyan (C), black (K), respectively. Image formation units 2Y, 2M, 2C, 2K are disposed in that order in transport direction A of intermediate transfer belt 12 that serves as an intermediate transfer body.

The disposition order of image formation units 2Y, 2M, 2C, 2K is not particularly limited. In the first embodiment, a case is exemplified where image formation device 1 has four image formation units. However, the number of image formation units is not particularly limited, and in addition to four-color image formation units 2Y, 2M, 2C, 2K, for instance, an image formation unit that uses a transparent toner or a white toner may be included.

Image formation units 2Y, 2M, 2C, 2K each have the same or a compatible configuration. Therefore, here the configuration of the four image formation units is described using, as an example, the configuration of image formation unit 2K.

Image formation unit 2K has photoconductive drum 3K as an image carrier, charge roller 4K that negatively charges the surface of photoconductive drum 3K uniformly, LED head 5K that performs light exposure on the surface of photoconductive drum 3K to form an electrostatic latent image, development roller 6K that develops the electrostatic latent image on the surface of photoconductive drum 3K with toner, supply roller 7K that supplies toner to the surface of development roller 6K and causes the toner to be charged by the friction with development roller 6K, development blade 8K that makes the toner form a uniform thin layer, the toner being supplied to the surface of development roller 6K, toner cartridge 9K that supplies toner to the surface of supply roller 7K, and cleaner blade 10K that cleans the residual toner off the surface of photoconductive drum 3K.

It is to be noted that image formation units 2Y, 2M, 2C also have the same configuration as that of image formation unit 2K. However, toner cartridges 9Y, 9M, and 9C store yellow (Y), magenta (M), and cyan (C) toner, respectively.

Here, "the second image carrier" described in the appended claims indicates the photoconductive drum of an image formation unit that is located downstream in the transport direction of intermediate transfer belt 12 that serves as the intermediate transfer body. In particular, "the second image carrier" is desirably the photoconductive drum of the image formation unit that is located the most downstream in the transport direction of the intermediate transfer body. Also, "the first image carrier" indicates the photoconductive drum of an image formation unit that is located upstream of the second image carrier.

Also, "the first transfer unit" described in the appended claims transfers a first developer image from the first image carrier to the intermediate transfer body. "The second transfer unit" transfers a second developer image from the second image carrier to the first developer image on the intermediate transfer body.

In addition, "the third transfer unit" described in the appended claims includes secondary transfer roller 22.

Primary transfer rollers 11Y, 11M, 11C, 11K are disposed as primary transfer members at respective positions opposed to photoconductive drums 3Y, 3M, 3C, 3K, with intermediate transfer belt 12 interposed therebetween. Each of primary transfer rollers 11Y, 11M, 11C, 11K is pressed against a corresponding one of photoconductive drums 3Y, 3M, 3C, 3K by an urging unit such as a spring with intermediate transfer belt 12 interposed therebetween, thereby forming a primary transfer nip. Application of a primary transfer voltage to primary transfer rollers 11Y, 11M, 11C, 11K causes a toner image to be transferred onto intermediate transfer belt 12 at each primary transfer nip in the order of yellow (Y), magenta (M), cyan (C) and black (K), the toner image being formed on the surface of each of photoconductive drums 3Y, 3M, 3C, 3K.

Intermediate transfer belt 12 is stretched by drive roller 13, driven roller 14, and secondary transfer backup roller 15 with a predetermined tension. Intermediate transfer belt 12 rotates in the direction of arrow A by the rotation of drive roller 13.

Recording medium storage cassette 17 stores recording medium 16. Hopping roller 18 takes out recording medium 16 stored in recording medium storage cassette 17 piece by piece. Recording medium 16 taken out by hopping roller 18 reaches the nip between registration roller 19 and pinch roller 20. Registration sensor 21 detects recording medium 16 reaching the nip between registration roller 19 and pinch roller 20. Registration roller 19 sends out recording medium 16 to a secondary transfer nip between secondary transfer roller 22 and secondary transfer backup roller 15 in synchronization with the timing of a toner image reaching the secondary transfer nip, the toner image being transferred onto intermediate transfer belt 12.

Secondary transfer roller 22 is disposed to be opposed to secondary transfer backup roller 15 with intermediate transfer belt 12 interposed therebetween. Secondary transfer roller 22 is pressed against secondary transfer backup roller 15 by an urging unit such as a spring with intermediate transfer belt 12 interposed therebetween, thereby forming the secondary transfer nip. A secondary transfer voltage is applied to secondary transfer roller 22 at the secondary transfer nip, and a toner image on intermediate transfer belt 12 is thereby transferred to recording medium 16.

Recording medium 16, which has passed secondary transfer roller 22, is separated from intermediate transfer belt 12 and is transported to fixture unit 23. Fixture unit 23 has heater 25 that heats heat roller 24 from the inside and pressure roller 26 that pressurizes heat roller 24. The fixture unit 23 heats, melts toner, and fixes a toner image on recording medium 16. Consequently, a full color image is formed. Recording medium 16, on which an image is formed, is guided to transport guide 27 to be delivered to stacker 28 in the upper portion of image formation device 1.

Cleaner blade 29 that removes residual toner on intermediate transfer belt 12 is disposed downstream (here between the secondary transfer nip and driven roller 14) of the secondary transfer nip of intermediate transfer belt 12. Also, cleaner blade opposed roller 30 is disposed at the position opposed to cleaner blade 29. Cleaner blade 29 is made of, for instance, a flexible rubber material or a plastic material. Cleaner blade 29 scrapes off secondary transfer residual toner into waste toner tank 31. The secondary transfer residual toner is toner remaining on the surface of intermediate transfer belt 12.

Figure 2:
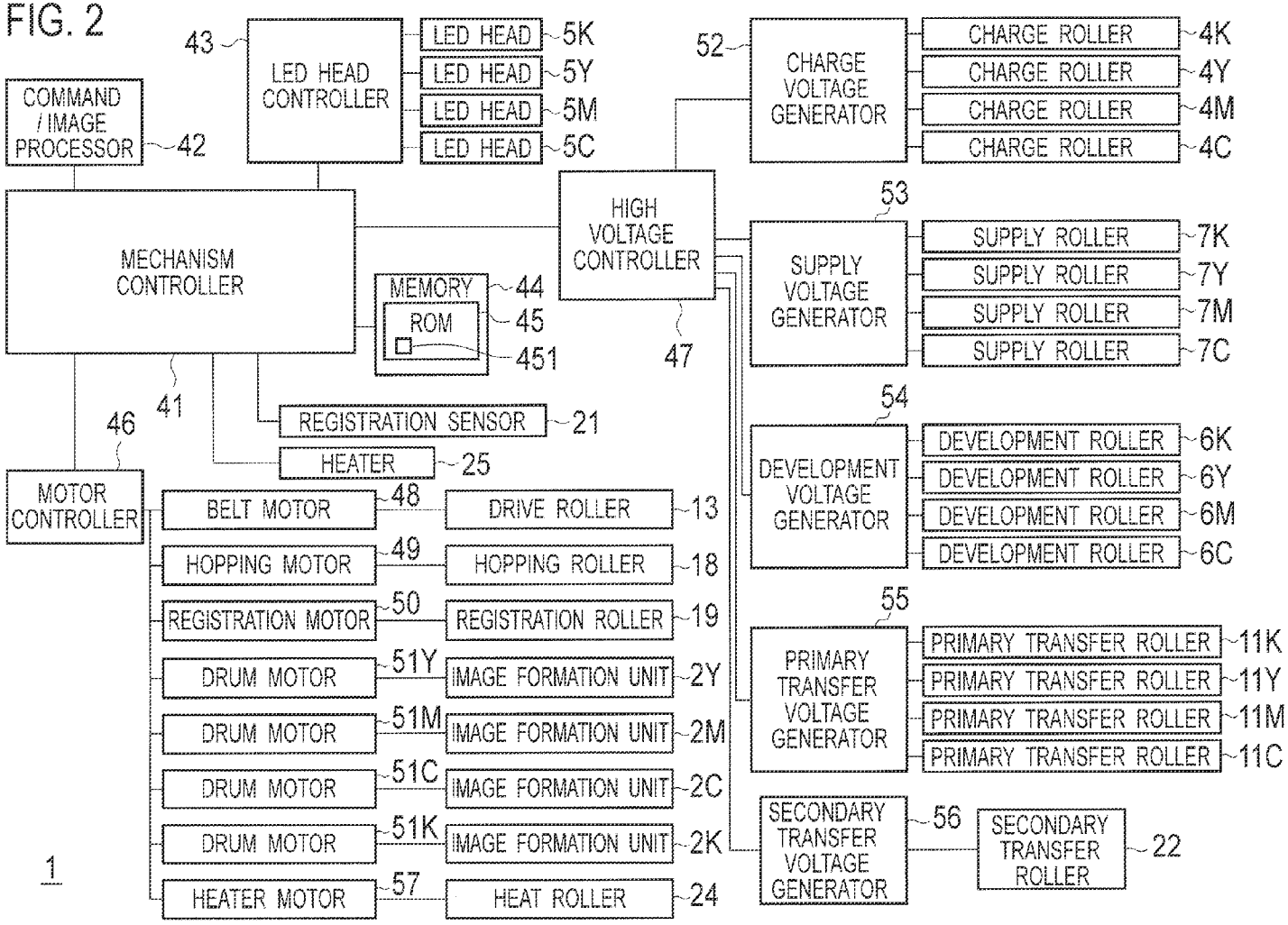
FIG. 2 is a block diagram illustrating the configuration of a control system and the connection relationship between components, the control system being a part of the image formation device according to the first embodiment.

Next, the configuration of a control system of image formation device 1 according to the first embodiment is described. FIG. 2 is a block diagram illustrating the configuration of a control system and the connection relationship between components, the control system being a part of image formation device 1 according to the first embodiment.

In FIG. 2, image formation device 1 includes mechanism controller 41, command/image processor 42, LED head controller 43, memory 44, motor controller 46, high voltage controller 47, registration sensor 21, heater 25, belt motor 48, hopping motor 49, registration motor 50, drum motors 51Y, 51M, 51C, 51K, heater motor 57, charge voltage generator 52, supply voltage generator 53, development voltage generator 54, primary transfer voltage generator 55, and secondary transfer voltage generator 56.

Mechanism controller 41 controls each component included in image formation device 1. Mechanism controller is connected to command/image processor 42, LED head controller 43, memory 44, motor controller 46, high voltage controller 47, registration sensor 21, and heater 25.

When mechanism controller 41 sends a primary transfer voltage value and a secondary transfer voltage value to high voltage controller 47, mechanism controller 41 sends the primary transfer voltage value and the secondary transfer voltage value according to the type of recording medium 16, the voltage values being set in transfer voltage setting table 451 stored in ROM 45 of memory 44.

Command/image processor 42 is a processor that processes, for instance, commands and print data from a host computer (not illustrated) and that transmits processed data to mechanism controller 41. In this process, command/image processor 42 also transmits setting information about recording medium 16 (for instance, information on whether recording medium 16 is regular paper or an OHP film) along with image data at the same time.

LED head controller 43 controls the light emission of LED heads 5Y, 5M, 5C, 5K based on the image data supplied from command/image processor 42 to mechanism controller 41.

Memory 44 stores data needed for the processing performed by mechanism controller 41. Memory 44 has ROM 45 that serves as a nonvolatile memory for storing each setting data. ROM 45 stores transfer voltage setting table 451 and others.

Transfer voltage setting table 451 sets the value of a voltage to be applied to each of primary transfer rollers 11Y, 11M, 11C, 11K and the value of a voltage to be applied to secondary transfer roller 22 according to the type of specified recording medium 16. That is, mechanism controller 41 is able to refer to transfer voltage setting table 451 and to control the voltage value for primary transfer and the voltage value for secondary transfer according to the type of recording medium 16 specified via command/image processor 42. A detailed description of transfer voltage setting table 451 is described later.

According to a command from command/image processor 42, motor controller 46 controls the drive of belt motor 48, hopping motor 49, registration motor 50, drum motors 51Y, 51M, 51C, 51K, heater motor 57, and thereby operates drive roller 13, hopping roller 18, registration roller 19, image formation units 2Y, 2M, 2C, 2K and heat roller 24.

High voltage controller 47 controls charge voltage generator 52, supply voltage generator 53, development voltage generator 54, primary transfer voltage generator 55, and secondary transfer voltage generator 56 according to a command from mechanism controller 41.

Charge voltage generator 52 generates or stops generating a charge voltage to charge rollers 4Y, 4M, 4C, 4K according to a command from high voltage controller 47. Supply voltage generator 53 generates or stops generating a supply voltage to supply rollers 7Y, 7M, 7C, 7K according to a command from high voltage controller 47. Development voltage generator 54 generates or stops generating a development voltage to development rollers 6Y, 6M, 6C, 6K according to a command from high voltage controller 47.

Primary transfer voltage generator 55 generates or stops generating a primary transfer voltage to primary transfer rollers 11Y, 11M, 11C, 11K according to a command from high voltage controller 47. According to the operation of image formation device 1 and the type of specified recording medium 16, primary transfer voltage generator 55 is able to change the value of a voltage, that is, the primary transfer voltage value to be applied to each of primary transfer rollers 11Y, 11M, 11C, 11K.

Secondary transfer voltage generator 56 is able to generate or stop generating a secondary transfer voltage to secondary transfer roller 22 according to a command from high voltage controller 47.

FIG. 3 is an explanatory diagram illustrating the configuration of transfer voltage setting table 451 according to the first embodiment.

In FIG. 3, transfer voltage setting table 451 defines the value of a voltage to be applied to each of primary transfer rollers 11Y, 11M, 11C, 11K and the value of a voltage to be applied to secondary transfer roller 22 according to the type of recording medium 16. In FIG. 3, "regular paper mode" is an operational mode when specified recording medium 16 is regular paper. "OHP mode" is an operational mode when specified recording medium 16 is an OHP film sheet. It is to be noted that although two types of operational modes are exemplified herein, the number of operational modes may be three or more.

For instance, in FIG. 3, "regular paper mode" indicates that a voltage of "1600 V" is applied to each of primary transfer roller 11Y for yellow toner, primary transfer roller 11M for magenta toner, primary transfer roller 11C for cyan toner, and primary transfer roller 11K for black toner. Also "regular paper mode" indicates that a voltage of "1800 V" is applied to secondary transfer roller 22.

For instance, "OHP mode" indicates that a voltage of "1600 V" is applied to each of primary transfer roller 11Y for yellow toner, primary transfer roller 11M for magenta toner, and primary transfer roller 11C for cyan toner, and a voltage of "3200 V" is applied to primary transfer roller 11K for black toner. Also "OHP mode" indicates that a voltage of "3200 V" is applied to secondary transfer roller 22.

Like this, when recording medium 16 is regular paper, the value of a voltage applied to primary transfer rollers 11Y, 11M, 11C, 11K is set to "1600 V" for all toner colors.

On the other hand, when recording medium 16 is an OHP film sheet, similarly to the case of regular paper, the value of a voltage applied to primary transfer rollers 11Y, 11M, 11C is set to "1600 V", however, only the voltage applied to primary transfer roller 11K is set to "3200 V". Also the "OHP mode" indicates that a voltage of "3200 V" is applied to secondary transfer roller 22.

The increase in the value of the primary transfer voltage applied to primary transfer roller 11K allows a highly charged black toner image to be primarily transferred onto intermediate transfer belt 12, with primary transfer roller 11K being disposed the most downstream in the transport direction of intermediate transfer belt 12. Accordingly, at the time of the secondary transfer, it is possible to increase the charge amount of a toner image secondarily transferred onto an OHP film sheet that serves as recording medium 16, and thus the adhesion of the black toner to the OHP film sheet is increased. Therefore, even when a discharge occurs on the surface of recording medium 16 after the secondary transfer and before the fixture, black toner is less likely to move and may be inhibited from causing a discharge pattern.

Figures 4, 5:
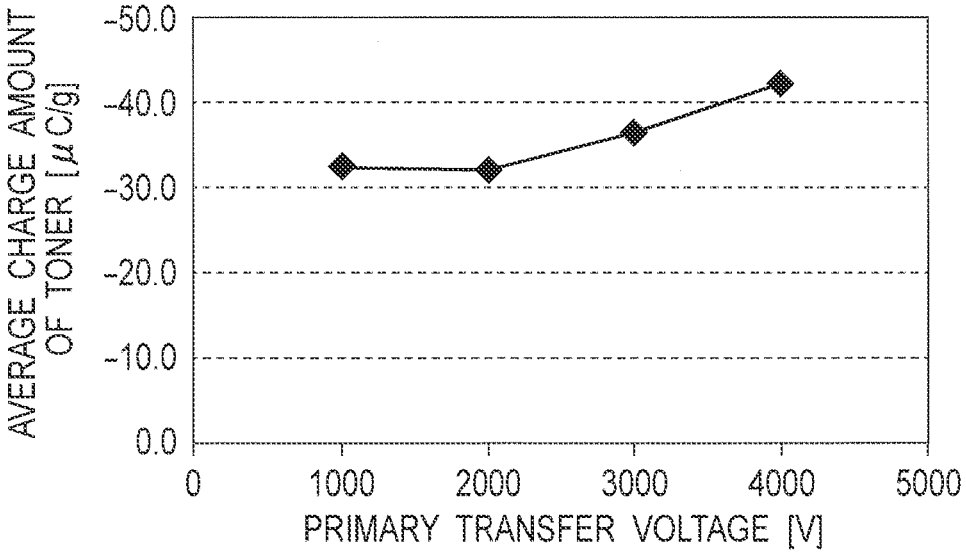
FIG. 4 is a relational table illustrating the relationship between a primary transfer voltage value and a discharge pattern that occurs on the surface of an OHP film sheet when the value of the primary transfer voltage is varied, where the primary transfer voltage is applied to a primary transfer roller of an image formation unit according to the first embodiment.
FIG. 5 is a graph illustrating the relationship between the value of a primary transfer voltage to be applied to the primary transfer roller according to the first embodiment and the average charge amount of the toner on an intermediate transfer belt after the primary transfer.

FIG. 4 is a relational table illustrating the relationship between a primary transfer voltage value and a discharge pattern that occurs on the surface of an OHP film sheet when the value of the primary transfer voltage is varied. The primary transfer voltage is to be applied to primary transfer roller 11K for image formation unit 2K according to the first embodiment.

In the experiment of FIG. 4, the occurrence of a discharge pattern is observed when a half-tone pattern of black toner is printed on an OHP film sheet of A4 size paper with a varied primary transfer voltage value.

In the experiment, the secondary transfer voltage is set to be fixed. As the index for a discharge pattern in the experiment, "×" is denoted when a discharge pattern occurs and "○" is denoted when no discharge pattern occurs so as to determine an occurrence level. Referring to the experimental results of FIG. 4, it is seen that when the value of the primary transfer voltage applied to primary transfer roller 11K is 3200 V or higher, no discharge pattern occurs.

FIG. 5 is a graph illustrating a relationship between value of a primary transfer voltage to be applied to the primary transfer roller 11K according to the first embodiment and the average charge amount of the toner on intermediate transfer belt 12 after the primary transfer.

The measurement of FIG. 5 is conducted using a charge amount measurement device (suction type small charge amount measurement device MODEL 210HS-3 manufactured by TREK JAPAN co. ltd). From the results of FIG. 5, when the primary transfer voltage value is "1200 V" or "2000 V", the average charge amount of toner on intermediate transfer belt 12 is approximately −32 μC/g. Also, when the primary transfer voltage value is "3200 V", the average charge amount of toner on intermediate transfer belt 12 is approximately −36.0 μC/g. In addition, when the primary transfer voltage value is "4000 V", the average charge amount of toner on intermediate transfer belt 12 is approximately −42 μC/g. From the results of FIG. 5, it is seen that the average charge amount of toner on intermediate transfer belt 12 is increased as the primary transfer voltage value is increased. Also, from FIG. 4 and FIG. 5, it is seen that when the primary transfer voltage value is "3200 V" or higher, adhering toner amount with no occurrence of a discharge pattern is −32 μC/g or greater.

Based on the above experimental results, when an image is formed on an OHP film, the toner charge is increased by setting the value of the primary transfer voltage to 3200 V, with the primary transfer voltage being applied to the most downstream primary transfer roller 11K. Because the adhesion of the toner to recording medium 16 is increased, any movement of the toner due to a discharge is not likely to occur, and thus a printing result without a discharge pattern is obtained. On the other hand, no discharge pattern occurs for printing on regular paper, and thus a favorable printing result is obtained by setting the primary transfer voltage to 1600 V.

(A-2) Operation of First Embodiment

Next, the operation of image formation device 1 according to the first embodiment is described in detail with reference to the accompanying drawings.

Figure 6:
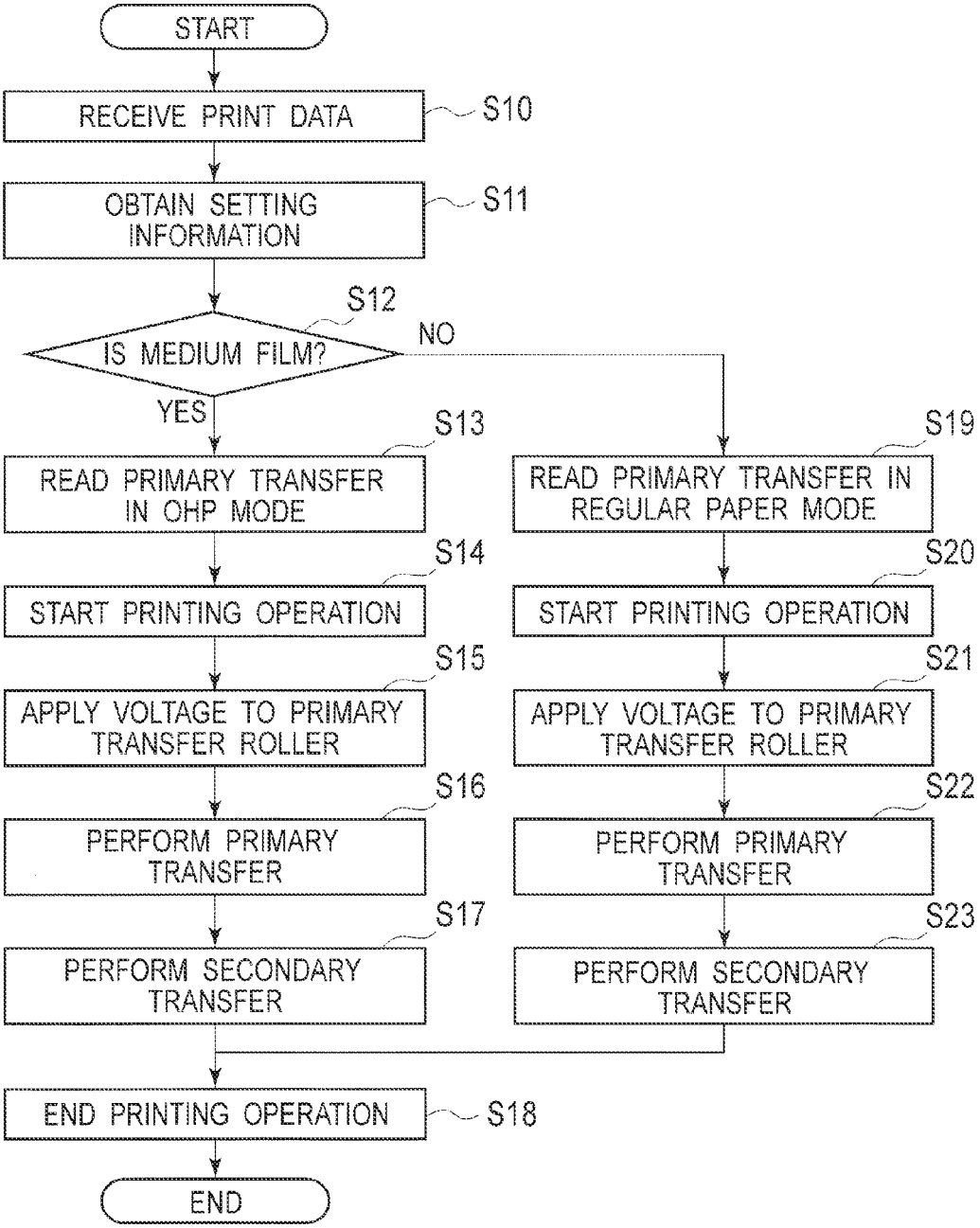
FIG. 6 is a flow chart illustrating the operation of the image formation device according to the first embodiment.

FIG. 6 is a flow chart illustrating the operation of image formation device 1 according to the first embodiment.

First, when print data is transmitted from a host computer (not illustrated) to image formation device 1, command/image processor 42 receives the print data (S10). Command/image processor 42 expands and processes the received print data, and transmits the expanded image data to mechanism controller 41. At this point, mechanism controller 41 also obtains at the same time the setting information regarding recording medium 16 used for the printing (S11).

Mechanism controller 41 then determines whether or not the type of recording medium 16 used for image formation is OHP film sheet based on the obtained setting information (S12). Here, when recording medium 16 used for the image formation is an OHP film sheet, the processing of mechanism controller 41 proceeds to step S13. On the other hand, when recording medium 16 used for the image formation is not an OHP film sheet, the processing of mechanism controller 41 proceeds to step S19.

Next, the case is described where recording medium 16 used for image formation is not an OHP film sheet (that is, regular paper).

First, mechanism controller 41 reads transfer voltage setting table 451 in regular paper mode from ROM 45 (S19). Next, mechanism controller 41 drives each component to start the printing operation (S20). When the printing operation is started, mechanism controller 41 first controls belt motor 48 and drum motor 51, drives drive roller 13 and image formation units 2 to transport intermediate transfer belt 12 in the direction of arrow A of FIG. 1. Next, mechanism controller 41 controls high voltage controller 47 and turns on charge voltage generator 52, supply voltage generator 53, and development voltage generator 54 to supply a predetermined voltage to image formation units 2Y, 2M, 2C, 2K.

Here, the toner image formation operation performed by image formation units 2Y, 2M, 2C, 2K is described. Mechanism controller 41 applies a voltage of "−1000 V" to charge roller 4, and charges the surface of photoconductive drum 3 to "−600 V". After photoconductive drum 3 is charged, mechanism controller 41 causes LED head 5 to emit light based on bit map data for performing light exposure on photoconductive drum 3. Thus, the charge of photoconductive drum 3 is reduced to "−50 V" and an electrostatic latent image is formed on the surface of photoconductive drum 3. The electrostatic latent image formed on photoconductive drum 3 reaches a contact portion with development roller 6 as photoconductive drum 3 rotates. Also, a voltage of "−200 V" is applied to development roller 6 and a voltage of "−250 V" is applied to supply roller 7. Thus, the toner supplied from toner cartridge 9 is frictionally charged to a negative polarity by development roller 6 and supply roller 7. The toner, by being frictionally charged to a negative polarity, adheres to development roller 6 due to a potential difference between development roller 6 and supply roller 7. The adhering toner is made to have a uniform thickness by development blade 8 and a toner layer is formed. The toner layer formed on development roller 6 is transported to a contact portion with photoconductive drum 3 by the rotation of development roller 6. In an exposed portion where the charge on the surface of photoconductive drum 3 is reduced to "−50V", an electric field between development roller 6 and photoconductive drum 3 is formed in a direction from photoconductive drum 3 to development roller 6. Therefore, the toner charged to a negative polarity on development roller 6 adheres to the exposed portion on the surface of photoconductive drum 3, and a toner image is formed.

Next, a primary transfer voltage is applied in synchronization with the timing of the toner image on photoconductive drum 3 reaching the primary transfer nip (S21). At this point, mechanism controller 41 commands high voltage controller 47 to apply a primary transfer voltage in accordance with read transfer voltage setting table 451 in the regular paper mode, and primary transfer voltage generator 55 controls the primary transfer voltage value. That is, a voltage of "1600 V" is applied to primary transfer rollers 11Y, 11M, 11C, 11K, and the toner image is transferred onto intermediate transfer belt 12 (S22).

Next, the toner image transferred onto intermediate transfer belt 12 is transported to the secondary transfer nip and is transferred to recording medium 16 by applying a predetermined secondary transfer voltage (S23). At this point, mechanism controller 41 commands high voltage controller 47 to apply a secondary transfer voltage in accordance with read transfer voltage setting table 451 in the regular paper mode, and secondary transfer voltage generator 56 controls the secondary transfer voltage value. That is, a voltage of "1800 V" is applied to secondary transfer roller 22. Recording medium 16, which has passed the secondary transfer nip, is transported to fixture unit 23. Recording medium 16, when reaching fixture unit 23, is transported while being pressed by heat roller 24 and pressure roller 26 which are controlled at a fixture enabling temperature, then a toner image is fixed on recording medium 16 (S18).

In the meantime, the case is described where recording medium 16 used for image formation is an OHP film sheet in S12.

Mechanism controller 41 reads transfer voltage setting table 451 in OHP mode from ROM 45 (S13). Next, mechanism controller 41 drives each component based on the received information to start the printing operation (S14). The operation of each component and the image formation operation in image formation unit 2 are the same as those in the case of regular paper, and thus a detailed description of the operation is omitted here.

Next, a primary transfer voltage is applied in synchronization with the timing of the toner image on photoconductive drum 3 reaching the primary transfer nip (S15).

At this point, mechanism controller 41 commands high voltage controller 47 to apply a primary transfer voltage in accordance with read transfer voltage setting table 451 in the OHP mode. Primary transfer voltage generator 55 controls the primary transfer voltage value for each primary transfer roller.

That is, a voltage of "1600 V" is applied to primary transfer rollers 11Y, 11M, 11C, and a toner image is transferred onto intermediate transfer belt 12. Also, a voltage of "3200 V" is applied to primary transfer roller 11K that is disposed the farthest, or most, downstream, and the toner image is transferred onto intermediate transfer belt 12 (S16).

Like this, a black (K) toner image, which is primarily transferred onto intermediate transfer belt 12 by the primary transfer voltage in the OHP mode, has a higher toner charge than a black (K) toner image which is primarily transferred in the regular paper mode. Thus as described above, even when a discharge occurs after the toner image is secondarily transferred to recording medium 16, the toner is less likely to move and no print failure occurs.

Next, the toner image transferred onto intermediate transfer belt 12 is transported to the secondary transfer nip and is transferred to recording medium 16 by applying a predetermined secondary transfer voltage value (S17). At this point, mechanism controller 41 commands high voltage controller 47 to apply a secondary transfer voltage in accordance with read transfer voltage setting table 451 in the OHP mode, and secondary transfer voltage generator 56 controls the secondary transfer voltage value. That is, a voltage of "3000 V" is applied to secondary transfer roller 22. Recording medium 16, which has passed the secondary transfer nip, is transported to fixture unit 23. The recording medium, which has passed the secondary transfer nip, is fixed by fixture unit 23 and is delivered to stacker 28 and the printing operation is completed (S18).

(A-3) Effect of First Embodiment

According to the first embodiment as described above, when an OHP film sheet is used as the recording medium, the primary transfer voltage value of the most downstream image formation unit (image formation unit 2K in the case of FIG. 1) in the transport direction out of the image formation units used for printing is made higher than the primary transfer voltage value in the case where regular paper is used as the recording medium. Thus the effect is obtained that the charge amount of the toner primarily transferred onto intermediate transfer belt 12 is increased.

Consequently, the charge amount of the toner transferred to the recording medium is also increased and the toner is less likely to move even when discharge occurs. Thus a printing result is obtained without the occurrence of a discharge pattern, even with use of an OHP film as the recording medium.

(B) Second Embodiment

Next, the operation of an image formation device according to a second embodiment is described in detail with reference to the accompanying drawings.

Similarly to the first embodiment, also in the second embodiment, a case is exemplified where the invention is applied to an electrophotographic image formation device that adopts an intermediate transfer system.

(B-1) Configuration of Second Embodiment

Figure 7:
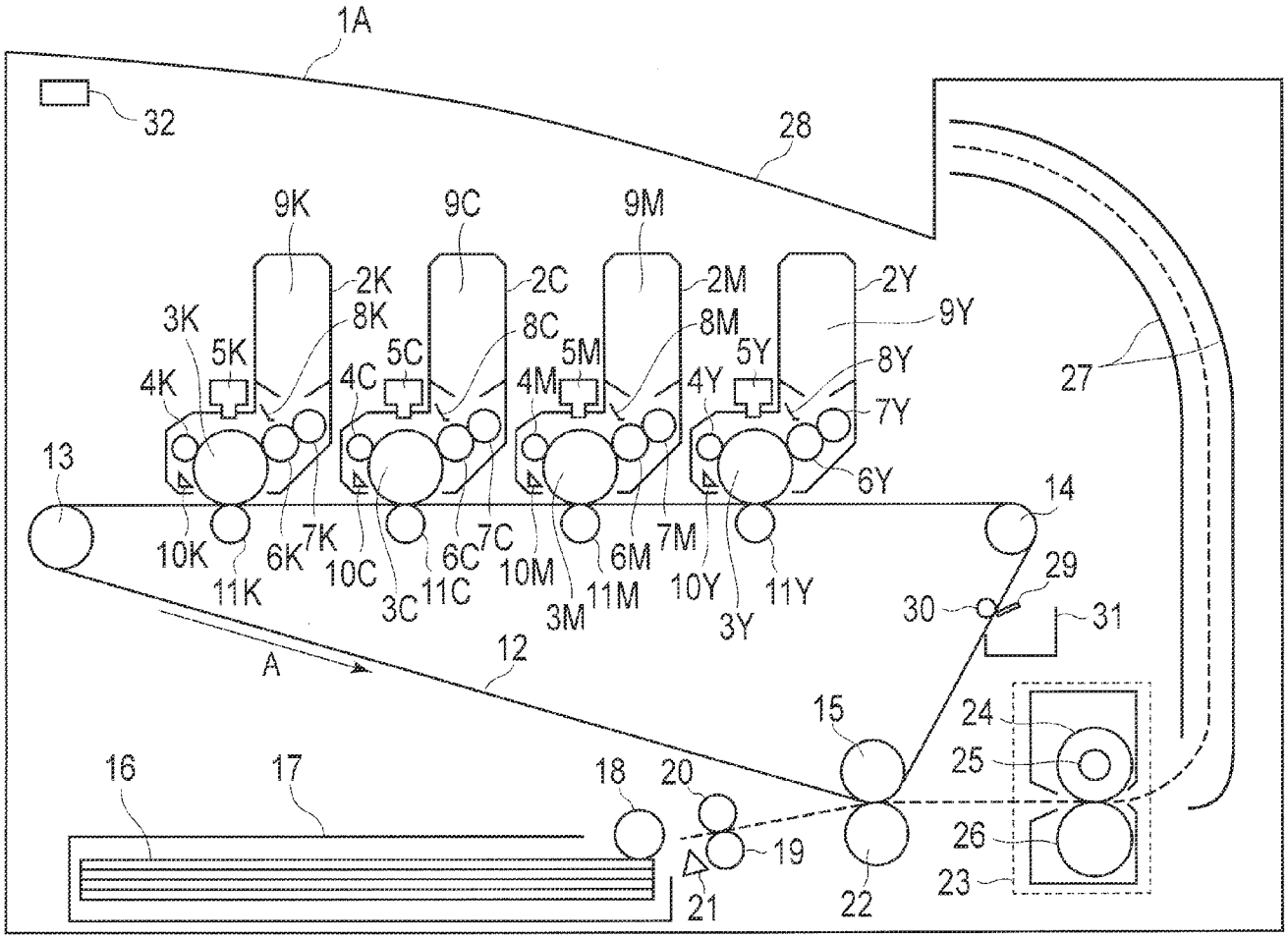
FIG. 7 is an internal configuration diagram illustrating the internal configuration of an image formation device according to a second embodiment.

FIG. 7 is an internal configuration diagram illustrating the internal configuration of image formation device 1A according to the second embodiment. It is to be noted that the same or corresponding components as or to those in the image formation device of FIG. 1 according to the first embodiment are denoted by the same symbol.

In FIG. 7, similarly to the first embodiment, image formation device 1A according to the second embodiment includes environmental sensor 32 in addition to image formation units 2Y, 2M, 2C, 2K that use respective developers (hereinafter referred to as toner) of four colors, recording medium storage cassette 17, hopping roller 18, registration roller 19, pinch roller 20, registration sensor 21, primary transfer rollers 11Y, 11M, 11C, 11K, intermediate transfer belt 12, drive roller 13, driven roller 14, secondary transfer backup roller 15, secondary transfer roller 22, fixture unit 23, transport guide 27, stacker 28, cleaner blade 29, cleaner blade opposed roller 30, and waste toner tank 31.

Environmental sensor 32 detects information on the environment in which image formation device 1A is installed. As environmental sensor 32, for instance, a temperature and humidity sensor, a single temperature sensor, or a single humidity sensor may be used. In the second embodiment, a case is exemplified where a temperature and humidity sensor is used as environmental sensor 32. As long as environmental sensor 32 is able to detect information on the environment (for instance, temperature data, humidity data) in which image formation device 1A is installed, the installed position is not particularly limited.

Here, a discharge pattern, which is an image defect and occurs in an OHP film as recording medium 16, is likely to occur in a low humidity and low temperature environment, a low humidity environment, or a low temperature environment. For this reason, in the second embodiment, environmental sensor 32 is installed in order to measure the temperature and humidity when a printing operation is performed.

Figure 8:
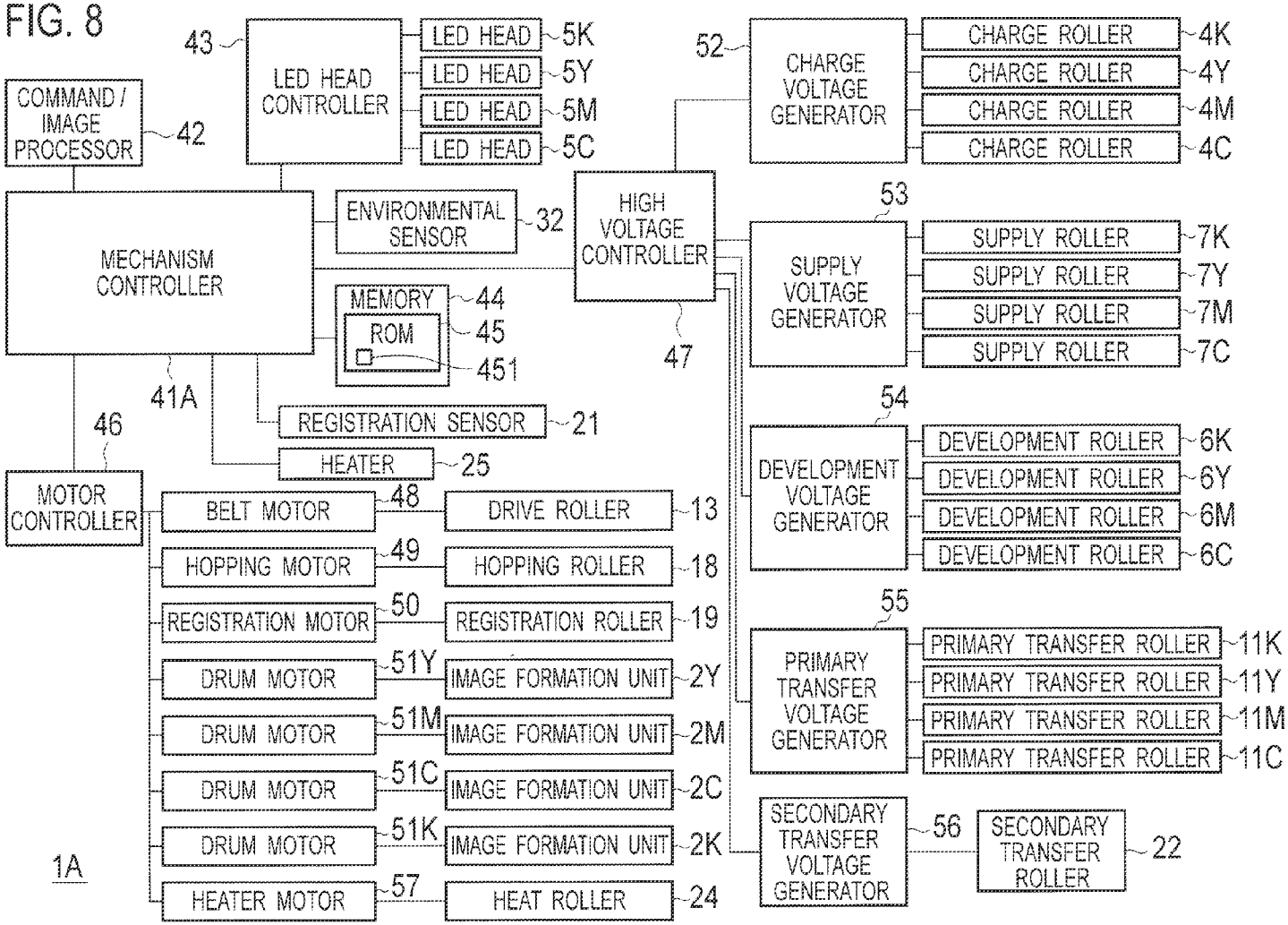
FIG. 8 is a block diagram illustrating the configuration of a control system and the connection relationship between components, the control system being a part of the image formation device according to the second embodiment.

FIG. 8 is a block diagram illustrating the configuration of a control system and the connection relationship between components, the control system being of image formation device 1A according to the second embodiment. It is to be noted that the same or corresponding components as or to those in the image formation device of FIG. 2 according to the first embodiment are denoted by the same symbols.

In FIG. 8, image formation device 1A includes environmental sensor 32 in addition to mechanism controller 41A, command/image processor 42, LED head controller 43, memory 44, motor controller 46, high voltage controller 47, registration sensor 21, heater 25, belt motor 48, hopping motor 49, registration motor 50, drum motors 51Y, 51M, 51C, 51K, heater motor 57, charge voltage generator 52, supply voltage generator 53, development voltage generator 54, primary transfer voltage generator 55, and secondary transfer voltage generator 56.

Environmental sensor 32 notifies mechanism controller 41A of detected environmental information. Environmental sensor 32 may detect environmental information, for instance, all the time, and may notify mechanism controller 41A of the environmental information, or may detect environmental information, for instance, periodically or intermittently, and may notify mechanism controller 41A of the environmental information.

Similarly to the first embodiment, when mechanism controller 41A sends a primary transfer voltage value and a secondary transfer voltage value to high voltage controller 47, mechanism controller 41 sends the primary transfer voltage value and the secondary transfer voltage value according to the type of recording medium 16, the voltage values being set in transfer voltage setting table 452 stored in ROM 45 of memory 44.

At this point, mechanism controller 41A reads from transfer voltage setting table 452 a primary transfer voltage value and a secondary transfer voltage value corresponding to the current environmental information (humidity data, temperature data) obtained from environmental sensor 32, and notifies high voltage control unit 47 of the primary and secondary transfer voltages.

As similar to the first embodiment, memory 44 has ROM 45. ROM 45 stores transfer voltage setting table 452 that defines the primary transfer voltage values and the secondary transfer voltage values.

FIG. 9 is an explanatory diagram illustrating the configuration of transfer voltage setting table 452 of image formation device 1A according to the second embodiment.

As illustrated in FIG. 9, transfer voltage setting table 452 defines the primary transfer voltage value and the secondary transfer voltage value for each of primary transfer rollers 11Y, 11M, 11C, 11K for each type of recording medium 16 and for each environmental information. That is, transfer voltage setting table 452 defines a primary transfer voltage value and a secondary transfer voltage value according to a value read from environmental sensor 32 in addition to a primary transfer voltage value and a secondary transfer voltage value according to the regular paper mode or the OHP mode.

Transfer voltage setting table 452 of FIG. 9 defines a primary transfer voltage value and a secondary transfer voltage value according to given conditions as follows.

Here, "low temperature environment" refers to the environment in which the temperature is lower than a predetermined value. Although low temperature environment may be set in any manner, in this embodiment, low temperature environment indicates that the temperature is lower than 10° C. Also, "low humidity environment" indicates that the humidity is lower than a predetermined value. Although low humidity environment may be set in any manner, in this embodiment, low humidity environment indicates that the humidity is lower than 20%.

In FIG. 9, when recording medium 16 is "regular paper (regular paper mode)" and the temperature is lower than 10° C. or the humidity is lower than 20%, the value of the voltage applied to each of primary transfer rollers 11Y, 11M, 11C, 11K is "1600 V" and the value of the voltage applied to secondary transfer roller 22 is "1800 V". This table is called transfer voltage setting table T1.

When recording medium 16 is "regular paper (regular paper mode)" and the temperature is 10° C. or higher and the humidity is 20% or higher, the value of the voltage applied to each of primary transfer rollers 11Y, 11M, 11C, 11K is "1500 V" and the value of the voltage applied to secondary transfer roller 22 is "1400 V". This table is called transfer voltage setting table T2.

When recording medium 16 is "OHP film sheet (OHP mode)" and the temperature is lower than 10° C. or the humidity is lower than 20%, the value of the voltage applied to primary transfer rollers 11Y, 11M, 11C is "1600 V", the value of the voltage applied to primary transfer rollers 11K is "3200

V", and the value of the voltage applied to secondary transfer roller 22 is "3000 V". This table is called transfer voltage setting table T3.

When recording medium 16 is "OHP film sheet (OHP mode)" and the temperature is 10° C. or higher and the humidity is 20% or higher, the value of the voltage applied to each of primary transfer rollers 11Y, 11M, 11C, 11K is "1500 V" and the value of the voltage applied to secondary transfer roller 22 is "2500 V". This table is called transfer voltage setting table T4.

(B-2) Operation of Second Embodiment

Next, the operation of image formation device 1A according to the second embodiment is described in detail with reference to the accompanying drawings.

Figure 10:
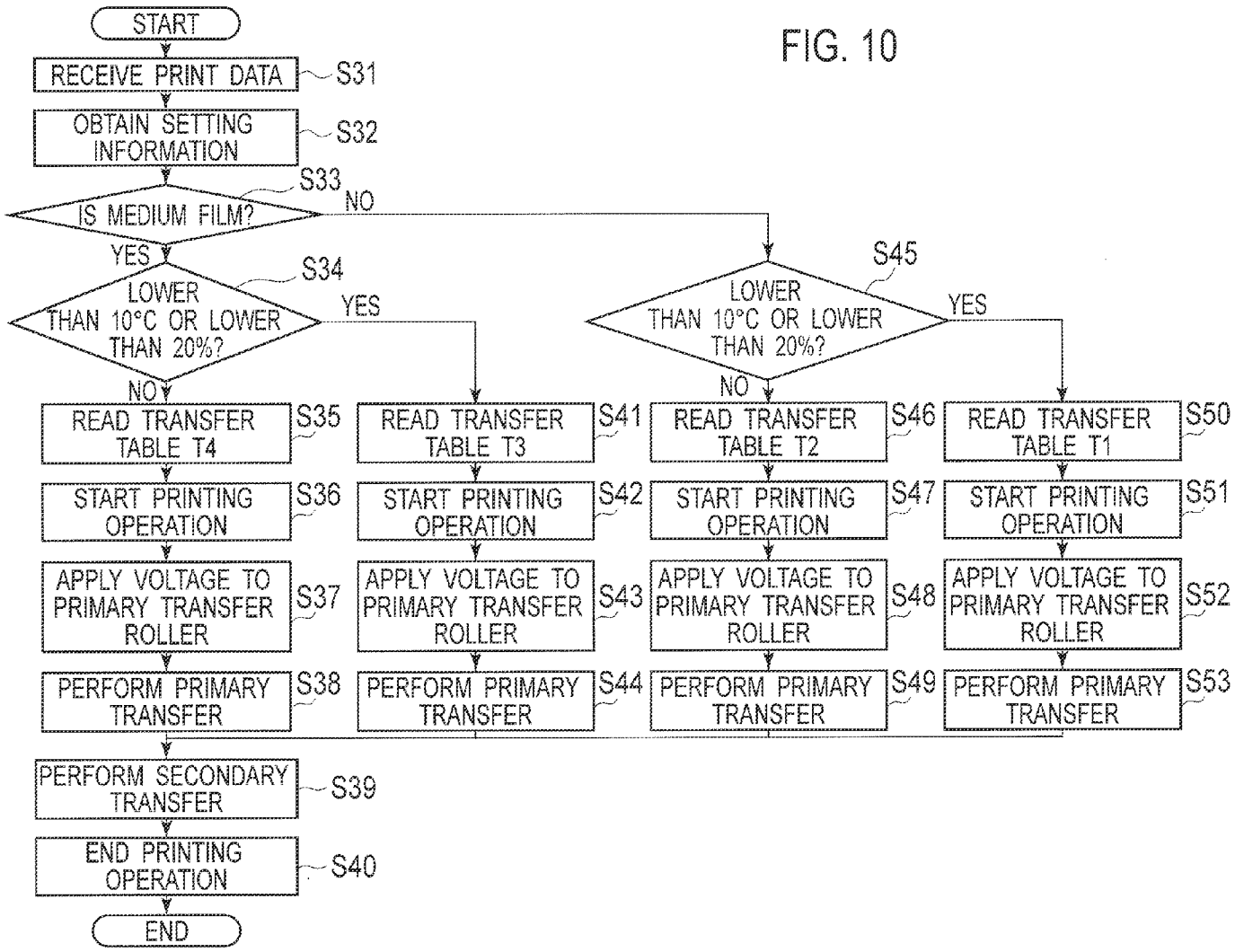
FIG. 10 is a flow chart illustrating the operation of the image formation device according to the second embodiment.

FIG. 10 is a flow chart illustrating the operation of the image formation device 1A according to the second embodiment. In the second embodiment, the basic printing operation of image formation device 1A is the same as that in the first embodiment.

First, when print data is transmitted from a host computer (not illustrated) to image formation device 1A, command/image processor 42 receives the print data (S31). Command/image processor 42 expands and processes the print data, and transmits the expanded data to mechanism controller 41A. At this point, mechanism controller 41A also obtains the setting information regarding recording medium 16 used for printing (S32).

Environmental sensor 32, when detecting environmental information, notifies mechanism controller 41A of the detected environmental information. It is to be noted that environmental sensor 32 detects environmental information periodically or intermittently and notifies mechanism controller 41A of the environmental information regardless of the type of recording medium 16 used for image formation. Mechanism controller 41A determines whether or not recording medium 16 used for image formation is an OHP film sheet based on the details of the obtained print setting information (S33).

Here, the case is exemplified where recording medium 16 is an OHP film sheet in S33. When recording medium 16 is determined to be an OHP film sheet by mechanism controller 41A in S33, the processing of mechanism controller 41A proceeds to S34.

In S34, mechanism controller 41A determines whether or not the temperature is lower than 10° C. or the humidity is lower than 20% based on the humidity value and the temperature value that are environmental information obtained from environmental sensor 32 (S34).

When the temperature is not lower than 10° C. or the humidity is not lower than 20% (that is, when the temperature is 10° C. or higher and the humidity is 20% or higher), mechanism controller 41A reads from ROM 45, Table T4 in the setting of transfer voltage setting table 452 of FIG. 9 (S35).

Mechanism controller 41A drives each component to start the printing operation (S36). When the printing operation is started, mechanism controller 41A first controls belt motor 48 and drum motor 51, drives drive roller 13 and image formation unit 2 to transport intermediate transfer belt 12 in the direction of arrow A of FIG. 1. Mechanism controller 41A controls high voltage controller 47 and turns on charge voltage generator 52, supply voltage generator 53, and development voltage generator 54 to supply a predetermined voltage to image formation units 2Y, 2M, 2C, 2K. Next, a primary transfer voltage is applied in synchronization with the timing of a toner image on photoconductive drum 3 reaching the primary transfer nip (S37). At this point, mechanism controller 41A commands high voltage controller 47 to apply a primary transfer voltage in accordance with read table T4 of transfer voltage setting table 452 in the OHP mode, and primary transfer voltage generator 55 controls the primary transfer voltage value. That is, a voltage of "1500 V" is applied to primary transfer rollers 11Y, 11M, 11C, 11K, and the toner image is transferred onto intermediate transfer belt 12 (S38). Next, the toner image transferred onto intermediate transfer belt 12 is transported to the secondary transfer nip and is transferred to recording medium 16 by applying a predetermined secondary transfer voltage (S39). At this point, mechanism controller 41A commands high voltage controller 47 to apply a secondary transfer voltage in accordance with read table T4 of transfer voltage setting table 452 in the OHP mode, and secondary transfer voltage generator 56 controls the secondary transfer voltage value. That is, a voltage of "2500 V" is applied to secondary transfer roller 22. Recording medium 16, which has passed the secondary transfer nip, is transported to fixture unit 23. Recording medium 16, when reaching fixture unit 23, is transported while being pressed by heat roller 24 and pressure roller 26 which are controlled at a fixture enabling temperature, then a toner image is fixed on recording medium 16 and the processing is completed (S40).

When the temperature is lower than 10° C. or the humidity is lower than 20% in S34, mechanism controller 41A reads from ROM 45, table T3 in the setting of transfer voltage setting table 452 of FIG. 9 (S41).

Mechanism controller 41A drives each component based on the received information to start the printing operation (S42). The operation of each component and the image formation operation in image formation unit 2 are the same as those in the case of regular paper, and thus a detailed description of the operation is omitted here.

Next, a primary transfer voltage is applied in synchronization with the timing of a toner image on photoconductive drum 3 reaching the primary transfer nip (S43). At this point, mechanism controller 41A commands high voltage controller 47 to apply a primary transfer voltage in accordance with read table T3 of transfer voltage setting table 452 in the OHP mode, and primary transfer voltage generator 55 controls the primary transfer voltage value for each primary transfer roller.

That is, a voltage of "1600 V" is applied to primary transfer rollers 11Y, 11M, 11C, and a toner image is transferred onto intermediate transfer belt 12. Also, a voltage of "3200 V" is applied to primary transfer roller 11K that is disposed the most downstream, and a toner image is transferred onto intermediate transfer belt 12 (S44).

Like this, a black (K) toner image, which is primarily transferred onto intermediate transfer belt 12 by the primary transfer voltage in the OHP mode, has a higher toner charge than a black (K) toner image which is primarily transferred in the regular paper mode. Thus as described above, even when a discharge occurs after the toner image is secondarily transferred to recording medium 16, the toner is less likely to move and no print failure occurs.

Next, the toner image transferred onto intermediate transfer belt 12 is transported to the secondary transfer nip and is transferred to recording medium 16 by applying a predetermined secondary transfer voltage (S39). At this point, mechanism controller 41A commands high voltage controller 47 to apply a secondary transfer voltage in accordance with read table T3 of transfer voltage setting table 452 in the OHP mode, and secondary transfer voltage generator 56 controls the secondary transfer voltage value. That is, a voltage of "3000 V" is applied to secondary transfer roller 22. The recording medium 16, which has passed the secondary transfer nip, is then fixed by fixture unit 23 and is delivered to stacker 28 and the printing operation is completed (S40).

In the meantime, a case is exemplified where recording medium 16 is regular paper in S33. When recording medium 16 is determined to be regular paper by mechanism controller 41A in S33, the processing of mechanism controller 41A proceeds to S45.

When the temperature is not lower than 10° C. or the humidity is not lower than 20% (that is, when the temperature is 10° C. or higher and the humidity is 20% or higher) in S45, mechanism controller 41A reads from ROM 45, table T2 in the setting of transfer voltage setting table 452 of FIG. 9 (S46).

Mechanism controller 41A drives each component based on the received information to start the printing operation (S47). Next, a primary transfer voltage is applied in synchronization with the timing of a toner image on photoconductive drum 3 reaching the primary transfer nip (S48). At this point, mechanism controller 41A commands high voltage controller 47 to apply a primary transfer voltage in accordance with read table T2 of transfer voltage setting table 452 in the regular paper mode, and primary transfer voltage generator 55 controls the primary transfer voltage value for each primary transfer roller. That is, a voltage of "1500 V" is applied to primary transfer rollers 11Y, 11M, 11C, 11K, and the toner image is transferred onto intermediate transfer belt 12 (S49). Next, the toner image transferred onto intermediate transfer belt 12 is transported to the secondary transfer nip and is transferred to recording medium 16 by applying a predetermined secondary transfer voltage value (S39). At this point, mechanism controller 41A commands high voltage controller 47 to apply a secondary transfer voltage in accordance with read table T2 of transfer voltage setting table 452 in the regular paper mode, and secondary transfer voltage generator 56 controls the secondary transfer voltage value. That is, a voltage of "1400 V" is applied to secondary transfer roller 22. The recording medium 16, which has passed the secondary transfer nip, is then fixed by fixture unit 23 and is delivered to stacker 28 and the printing operation is completed (S40).

On the other hand, when the temperature is lower than 10° C. or the humidity is lower than 20% in S45, mechanism controller 41A reads from ROM 45, table T1 in the setting of transfer voltage setting table 452 of FIG. 9 (S50).

Mechanism controller 41A drives each component based on the received information to start printing operation (S51). Next, a primary transfer voltage is applied in synchronization with the timing of a toner image on photoconductive drum 3 reaching the primary transfer nip (S52). At this point, mechanism controller 41A commands high voltage controller 47 to apply a primary transfer voltage in accordance with read table T1 of transfer voltage setting table 452 in the regular paper mode, and primary transfer voltage generator 55 controls the primary transfer voltage value for each primary transfer roller. That is, a voltage of "1600 V" is applied to primary transfer rollers 11Y, 11M, 11C, 11K, and the toner image is transferred onto intermediate transfer belt 12 (S53). Next, the toner image transferred onto intermediate transfer belt 12 is transported to the secondary transfer nip and is transferred to recording medium 16 by applying a predetermined secondary transfer voltage value (S39). At this point, mechanism controller 41A commands high voltage controller 47 to apply a secondary transfer voltage in accordance with read table T1 of transfer voltage setting table 452 in the regular paper mode, and secondary transfer voltage generator 56 controls the secondary transfer voltage value. That is, a voltage of "1800 V" is applied to secondary transfer roller 22. The recording medium 16, which has passed the secondary transfer nip, is then fixed by fixture unit 23 and is delivered to stacker 28 and the printing operation is completed (S40).

(B-3) Effect of Second Embodiment

According to the second embodiment as described above, in addition to the effect of the first embodiment, control is performed based on the printing environment detected by the environmental sensor such that when an OHP film is used as the recording medium in a low humidity and low temperature environment, a low humidity environment, or a low temperature environment, the primary transfer voltage value of image formation unit 2K that is located the most downstream (the farthest downstream) in the transport direction is increased. Therefore, the primary transfer voltage value is not increased unnecessarily at a temperature or a humidity at which no discharge pattern occurs, and a printing result is obtained without the occurrence of a discharge pattern at a low temperature and a low humidity, at which a discharge pattern may otherwise occur.

(C) Other Embodiments

Although various modified embodiments have been referred to in the above-described first and second embodiments, the invention is also applicable to the following modified embodiments.

(C-1) Although the case has been described where four image formation units 2Y, 2M, 2C, 2K are used for printing in the first and second embodiments, the number, the order of the image formation units and the color of the toner used for each image formation unit are irrelevant to the effect. That is, when an OHP film is used, by increasing the primary transfer voltage of the most downstream image formation unit among the image formation units used for printing, it is possible to print the OHP film without the occurrence of a discharge pattern.

For instance, it is sufficient that the application voltage to the primary transfer roller of any downstream image formation unit in the transport direction be set higher than the application voltage to the primary transfer roller of any upstream image formation unit in the transport direction of the intermediate transfer belt that serves as an intermediate transfer body. More specifically, in the case of the example of FIG. 1, the application voltage may be "1200 V" for primary transfer roller 11Y, "1400 V" for primary transfer roller 11M, "1600 V" for primary transfer roller 11C, and "3200 V" for primary transfer roller 11K. In this manner, the application voltage to any downstream primary transfer roller can be set higher than the application voltage to any upstream primary transfer roller, and consequently, the application voltage to the most downstream primary transfer roller can be set to be higher than the application voltage to any upstream primary transfer roller.

(C-2) The values of primary transfer voltage and secondary transfer voltage, which are illustrated in FIG. 3 for the above-described first embodiment and FIG. 9 for the above-described first embodiment, are not limited to the values illustrated in FIG. 3 and FIG. 9. For instance, the primary transfer voltage value in the OHP mode is not limited to 3200 V and may be a value of 3200 V or higher because developer images can be held on the intermediate transfer body as long as the primary transfer voltage value is 3200 V or higher.

(C-3) The value of each primary transfer voltage in the transfer voltage setting table described in the first and second embodiments is not necessarily a fixed value and may be a variable value.

For instance, in the first and second embodiments described above, only the primary transfer voltage value of the primary transfer roller opposed to the most downstream image formation unit is set to be higher than the voltage values of other primary transfer rollers. However, in the image formation device using plural types of developers illustrated to FIG. 1, the application voltage to any downstream primary transfer roller may be changed to be higher than the application voltage to any upstream primary transfer roller according to the image formation units actually used, for instance, like the case where a developer image is formed without using black toner (that is, an image is formed without using the most downstream image formation unit). In this manner, even when the most downstream image formation unit is not used, by increasing the application voltage to any downstream primary transfer roller, the same effect as the effect of the first and second embodiments is achieved.

(C-4) In the second embodiment, the case is exemplified where three environmental states of (1) a low temperature and low humidity environment, (2) a low humidity environment, and (3) a low temperature environment are determined, and when one of the three environmental states is applicable, the application voltage value to any downstream primary transfer roller is set to be higher than the application voltage value to the other primary transfer rollers. Although the case is exemplified where the same table T3 is used in the three environmental states in the second embodiment, voltage control may be performed using different tables for the three environmental states.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation device for forming developer images using plural types of developers, the image formation device comprising:

a first image carrier configured to carry a first developer image;

a second image carrier configured to carry a second developer image;

an intermediate transfer body disposed to be opposed to the first image carrier and the second image carrier;

a first transfer unit configured to transfer the first developer image from the first image carrier to the intermediate transfer body;

a second transfer unit configured to transfer the second developer image from the second image carrier to the intermediate transfer body on which the first developer image is held;

a third transfer unit configured to transfer, to a recording medium, the first developer image and the second developer image transferred onto the intermediate transfer body; and a control unit configured to control a value of a voltage to be applied to each of the first transfer unit and the second transfer unit, according to a type of the recording medium opposed to the intermediate transfer body, wherein when the recording medium is a recording medium of a first type, the control unit applies a first transfer voltage to the first transfer unit and the second transfer unit, and when the recording medium is a recording medium of a second type different from the first type recording medium, the control unit applies the first transfer voltage to the first transfer unit and applies a second transfer voltage different from the first transfer voltage to the second transfer unit.

2. The image formation device according to claim 1, wherein when the second type recording medium has a thickness larger than a thickness of the first type recording medium, and the second transfer voltage is higher than the first transfer voltage.

3. The image formation device according to claim 2, wherein the first type recording medium is regular paper and the second type recording medium is one of thick paper and a resin medium.

4. The image formation device according to claim 1, further comprising an environmental information detector configured to detect environmental information, wherein the control unit controls a value of a voltage to be applied to each of the first transfer unit and the second transfer unit, according to the type of the recording medium and the environmental information from the environmental information detector.

5. The image formation device according to claim 4, wherein the environmental information detector comprises a temperature detector.

6. The image formation device according to claim 1, wherein the second transfer unit is located most downstream in a rotation direction of the intermediate transfer body.

7. The image formation device according to claim 1, wherein the second type recording medium has a resistance value higher than that of the first type recording medium, and the second transfer voltage is higher than the first transfer voltage.

8. An image formation device comprising:

three or more image carriers configured to carry developer images of mutually different developers;

an intermediate transfer body disposed to be opposed to the image carriers;

primary transfer units configured to transfer the developer images on the image carriers to the intermediate transfer body in such a manner that the developer images are superimposed one on another;

a secondary transfer unit configured to transfer the superimposed developer images on the intermediate transfer body to a recording medium;

a detector configured to detect a type of the recording medium; and a control unit configured to make a voltage to be applied to the most downstream primary transfer unit among the primary transfer units higher than a voltage to be applied to the other primary transfer units and also higher than a voltage to be applied to the secondary transfer unit, when the detected type of the recording medium is a predetermined type.

9. The image formation device according to claim 8, wherein the predetermined type of recording medium is one of thick paper and a resin medium.

10. The image formation device according to claim 7, wherein the first type recording medium is regular paper and the second type recording medium is one of thick paper and a resin medium.

* * * * *